US009265307B2

(12) United States Patent
Cooper et al.

(10) Patent No.: US 9,265,307 B2
(45) Date of Patent: Feb. 23, 2016

(54) STRAP GUIDE INSERT

(71) Applicant: LINCOLN GLOBAL, INC., City of Industry, CA (US)

(72) Inventors: William Cooper, Chardon, OH (US); Richard Andzel, Jamestown, NY (US); Randal P. Stuart, Jamestown, NY (US)

(73) Assignee: Lincoln Global, Inc., City of Industry, CA (US)

( * ) Notice: Subject to any disclaimer, the term of this patent is extended or adjusted under 35 U.S.C. 154(b) by 0 days.

(21) Appl. No.: 14/600,318

(22) Filed: Jan. 20, 2015

(65) Prior Publication Data

US 2015/0129445 A1 May 14, 2015

Related U.S. Application Data

(63) Continuation of application No. 13/830,661, filed on Mar. 14, 2013, now Pat. No. 8,967,690, which is a continuation of application No. 13/766,187, filed on Feb. 13, 2013, now abandoned.

(60) Provisional application No. 61/760,549, filed on Feb. 4, 2013, provisional application No. 61/691,496, filed on Aug. 21, 2012, provisional application No. 61/598,191, filed on Feb. 13, 2012.

(51) Int. Cl.

| | |
|---|---|
| ***B61C 3/00*** | (2006.01) |
| ***B65D 51/00*** | (2006.01) |
| ***E04G 21/02*** | (2006.01) |
| ***E21B 27/00*** | (2006.01) |
| ***A44B 11/00*** | (2006.01) |

(Continued)

(52) U.S. Cl.

CPC ..... *A44B 11/005* (2013.01); *B65D 19/38* (2013.01); *B65D 25/22* (2013.01); *B65D 85/04* (2013.01); *B65D 88/1675* (2013.01); *B65D 90/0033* (2013.01); *B65D 2519/00786* (2013.01); *Y10T 24/39* (2015.01); *Y10T 24/4098* (2015.01)

(58) Field of Classification Search

CPC ..... B60R 22/24; B60R 22/26; B60R 22/18; B60R 2022/1818; B60R 22/48; B60R 22/02; B60N 2/688; A44B 11/04; A44B 11/02; A44B 11/18; A44B 11/005; A41F 3/00; A41F 11/16; B65D 90/0033; B65D 21/0224; B65D 21/0213; B65D 88/121; B65D 88/1675; B65D 19/38; B65D 25/22; B65D 2519/00786; B65D 85/04; B66C 1/663; B66C 1/12; B66C 1/24; B66C 1/28; B66C 1/32; B66C 1/16; B66C 1/22; Y10T 24/39; Y10T 24/4098

USPC ..... 280/808, 801.1; 297/481–483; 24/197–198, 200; 294/68.3

See application file for complete search history.

(56) References Cited

U.S. PATENT DOCUMENTS 3,262,729 A * 7/1966 Willison et al. ..... 294/68.3
5,382,066 A * 1/1995 Kelly ..... 294/68.3

(Continued)

FOREIGN PATENT DOCUMENTS

KR 2011 0066379 A 6/2011

*Primary Examiner* — Stephen Vu
(74) *Attorney, Agent, or Firm* — Hahn Loeser & Parks LLP

(57) ABSTRACT

A strap guide used in connection with a container having at least one opening for receiving a strap. The strap guide can include a boss defining a strap slot. The boss can have a periphery and two sides. A lip on the one of the two sides can extend outward relative to the boss, and a flange on the other of the two sides can also extend outward relative to the boss. At least a strap protector and a container for use with strap guide inserts can also be provided.

18 Claims, 11 Drawing Sheets

(51) Int. Cl.

| | |
|---|---|
| ***B65D 88/16*** | (2006.01) |
| ***B65D 90/00*** | (2006.01) |
| ***B65D 19/38*** | (2006.01) |
| ***B65D 25/22*** | (2006.01) |
| ***B65D 85/04*** | (2006.01) |

(56) References Cited

U.S. PATENT DOCUMENTS

| | | | | |
|---|---|---|---|---|
| 5,573,293 | A * | 11/1996 | Baumann et al. | 294/68.1 |
| 5,601,311 | A | 2/1997 | Pfeiffer et al. | |
| 5,782,519 | A * | 7/1998 | Baumann | 294/68.3 |
| 6,113,146 | A | 9/2000 | Mautsch et al. | |
| 6,220,468 | B1 * | 4/2001 | Lee | 220/1.5 |
| 6,290,259 | B1 | 9/2001 | Drobot et al. | |
| 6,338,513 | B1 * | 1/2002 | Williams | 294/68.1 |
| 7,192,057 | B2 | 3/2007 | Moendel et al. | |
| 7,597,359 | B2 | 10/2009 | Gray | |
| 7,600,786 | B2 | 10/2009 | You | |
| 8,967,690 | B2 | 3/2015 | Cooper et al. | |
| 2004/0007612 | A1 | 1/2004 | Johanson et al. | |

* cited by examiner

STRAP GUIDE INSERT

CROSS-REFERENCE TO RELATED APPLICATIONS AND INCORPORATION BY REFERENCE

This U.S. patent application is a continuation of and claims the benefit of U.S. non-provisional patent application Ser. No. 13/830,661 filed on Mar. 14, 2013, which is incorporated herein by reference in its entirety. Priority application Ser. No. 13/830,661 is in turn a continuation of U.S. non-provisional patent application Ser. No. 13/766,187 filed on Feb. 13, 2013, as well as U.S. provisional patent application 61/760,549 filed on Feb. 4, 2013, which are incorporated herein by reference in their entirety. U.S. non-provisional patent application Ser. No. 13/766,187 claims the benefit of U.S. provisional patent application 61/691,496, filed Aug. 21, 2012, as well as U.S. provisional patent application 61/598,191 filed Feb. 13, 2012, which are additionally incorporated by reference.

TECHNICAL FIELD

The invention can generally relate to containers for holding and moving material. More particularly, the invention can relate to a strap guide insert and/or protector for use with a container. Most particularly, the present invention can relate to a strap guide insert and/or protector that can be inserted into an opening in a wall of a container to reinforce the opening and receive a strap used to lift, move, reinforce, bind, or perform other action on or related to the container.

BACKGROUND OF THE INVENTION

Containers are used in a variety of applications to hold materials. To facilitate moving the containers, various openings, hand holds, and/or connectors may be provided in the walls of the container. In some cases, a strap, wire, chain, or other member may be threaded through or otherwise attached at the opening. In general, the walls of the container are relatively thin and the openings are prone to wear, fatigue, and tearing when repeatedly used to handle the container. In some instances, when heavy loads are placed in the container, the wall surrounding the opening may simply fail when attempting to lift or move the container using a strap threaded through the opening.

For example, cardboard containers are used to transport welding consumables including coils of welding wire. These coils may weigh upwards of 500 kilograms. The containers have opposing openings in their sidewalls. A strap is threaded through the openings and is used to lift and move the container with machinery, such as a crane, picker, or other implement. To prevent the strap from tearing through the wall of the container at the opening, fiber-reinforced tape is applied around the opening. Application of the tape is a manual process and requires significant time to install.

SUMMARY OF THE INVENTION

The present invention provides a strap guide insert that is inserted within an opening in a container to reinforce the opening and reduce the likelihood of failure of the container near the opening.

The present invention generally provides a strap guide used in connection with a container having at least one opening for receiving a strap, the strap guide comprising at least a strap boss defining a strap slot for receiving the strap, the strap boss, the strap boss having a periphery, a first side and a second side, a flange extending outward of the periphery of the strap boss, and a lip extending outward relative to the strap boss, wherein the lip is formed on the first side of the strap boss and the flange is formed on the second side of the strap boss.

In specific embodiments, a strap protector can be provided. The strap protector can include a strap protector body having a plate portion having opposed first and second sides and the strap protector guide portion extends from the first side, and a strap protector guide portion having a first internal sloped surface opposite a second internal sloped surface and a first internal spacing surface opposite a second internal spacing surface, the first internal spacing surface meets with the first internal sloped surface and the second internal sloped surface, and the second internal sloped surface meets with the first internal sloped surface and the second internal sloped surface, wherein the first internal sloped surface, the second internal sloped surface, and the first and second internal spacing surfaces define a strap opening in the strap protector body The innovation can also include a container for use with a strap guide or strap protector. Such a container can comprise two or more interfaces configured to accept two or more strap guides, wherein the two or more interfaces have a teardrop shape with a wide portion and a narrow portion, the wide portion configured to accept a boss includes a strap receiver, and the narrow portion configured to support at least one lug to prevent rotation of the two or more strap guides.

The following description and the annexed drawings set forth in detail certain illustrative aspects of the claimed subject matter. These aspects are indicative, however, of but a few of the various ways in which the principles of the innovation may be employed and the claimed subject matter is intended to include all such aspects and their equivalents. Other advantages and novel features of the claimed subject matter will become apparent from the following detailed description of the innovation when considered in conjunction with the drawings.

DETAILED DESCRIPTION OF THE INVENTION

Figure 1:
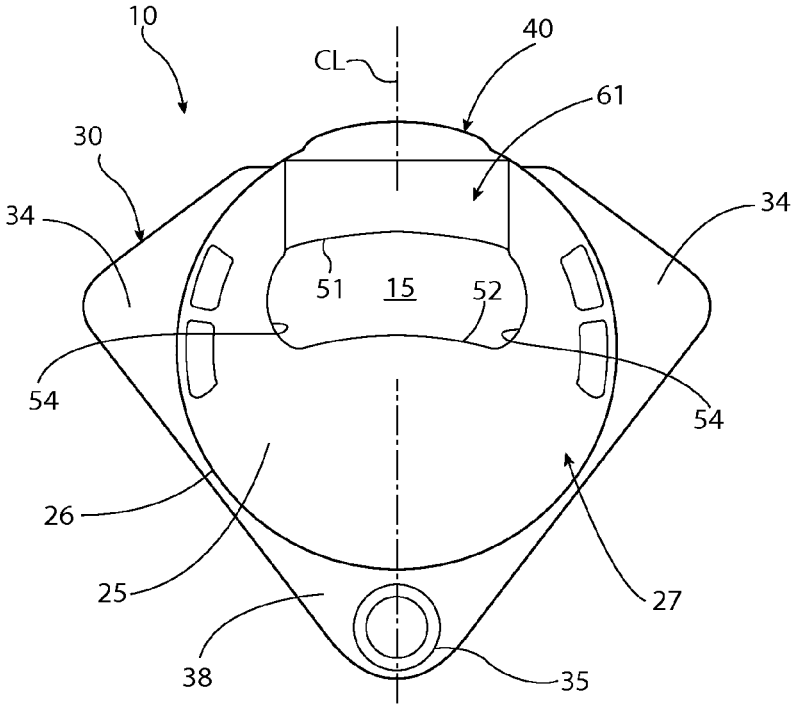
FIG. 1 is a front view of an embodiment of a strap guide according to the invention.
Figure 2:
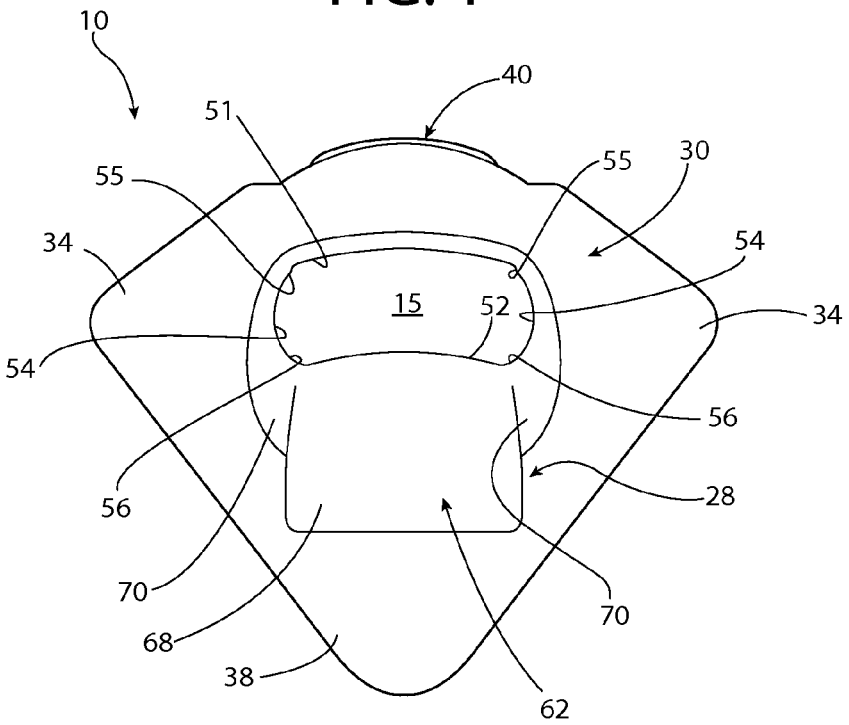
FIG. 2 is a rear view thereof.
Figure 3:
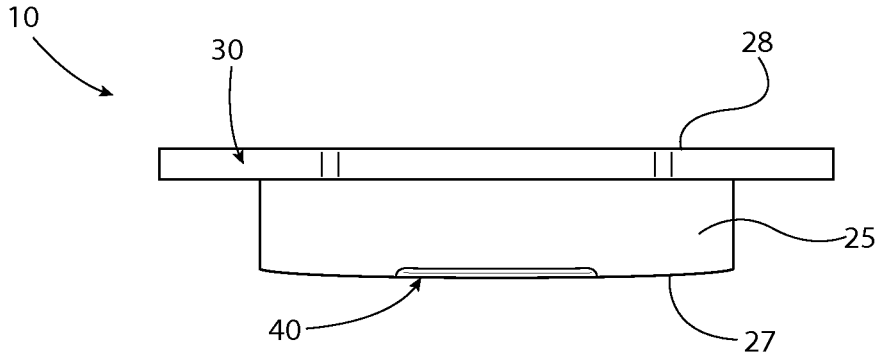
FIG. 3 is a top plan thereof.
Figure 4:
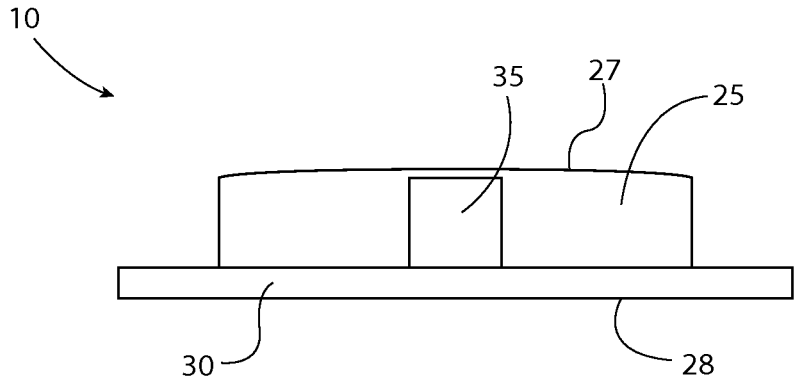
FIG. 4 is a bottom plan thereof.
Figure 5:
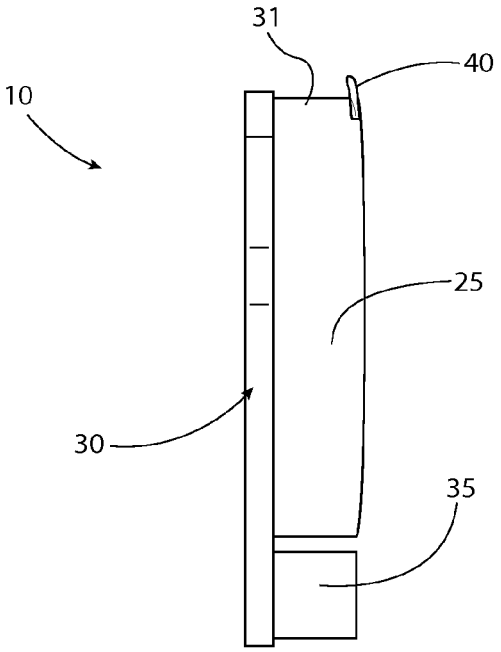
FIG. 5 is a left side view thereof.
Figure 6:
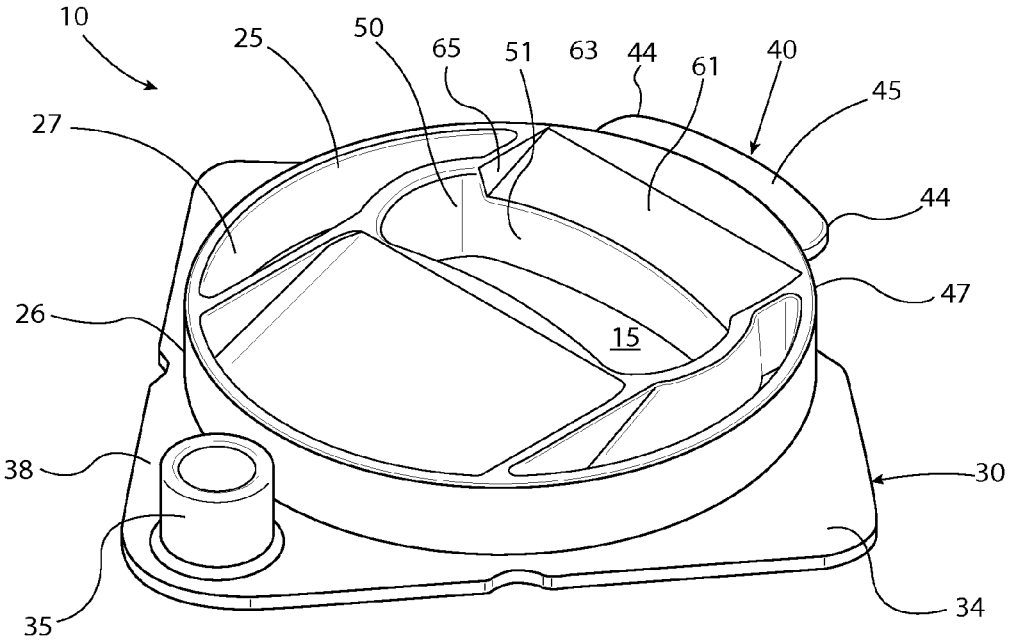
FIG. 6 is a front perspective view thereof.
Figure 7:
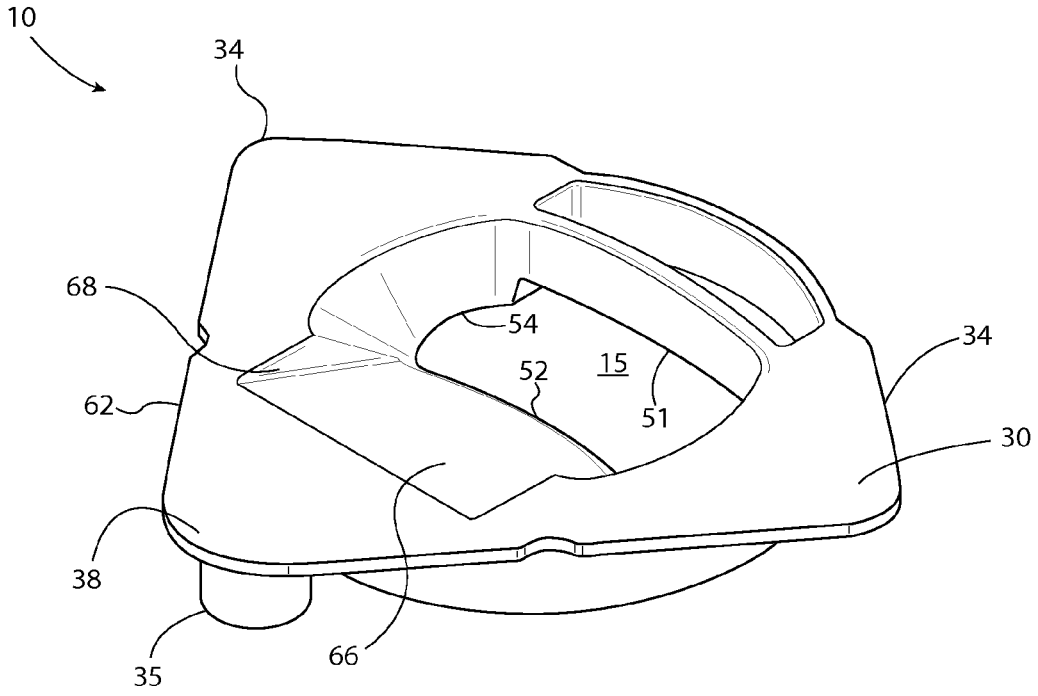
FIG. 7 is a rear perspective view thereof.

The innovation herein can include a strap guide insert configured to receive a strap used for moving or binding a container. The strap guide insert can be inserted within or attached to the container to provide a high-strength portion with which straps can interface. Straps can interface with the strap guide insert through various slots, receivers, guides, et cetera. In addition, the strap guide insert can distribute loads over a greater surface area and/or different material(s).

As used herein, the term "strap" can refer to any member that can be attached to container C to facilitate movement, closure, reinforcement, joining or combining (e.g., straps used to secure a plurality of boxes against one another), et cetera, of the container C. Illustrated strap S may include flexible and/or rigid members constructed of any suitable material based on the load to be carried by the strap and type of movement of the container C. In examples herein, strap S can be a length of nylon webbing. However, such examples should not be interpreted as limiting, and other materials and/or composites (e.g., other fabrics or synthetics, polymer bands, metal bands, woven or braided materials, and others) can be utilized with a generic or specially adapted strap guide insert.

As used herein, a "container" can be any object, product, material, et cetera, that at least partially surrounds one or more materials to be contained in the container. In examples herein including the figures, a container (e.g., container C) can be a box. However, containers may have any shape or configuration including cylindrical or polygonal shapes including, for example, a four sided, six sided, or eight sided polygonal shape. Various other flat-walled and/or rounded configurations (and others) can be recognized under the disclosures herein without departing from the scope or spirit of the innovation. A container may also include custom shapes or configurations depending upon the application for the container and the designer's creative choices. Therefore, references to one or more containers are not limited to particular containers or examples that are illustrated or discussed herein. In general, containers can have an upstanding wall (e.g., wall W) or other surface through which a strap (e.g., strap S) can be inserted or otherwise connected. Nonetheless, embodiments not employing an upstanding wall (e.g., annular wall, container is flexible material such as a cloth wrap, container is a flat surface on which contained items are stacked, and others) will be appreciated upon review of the disclosures herein.

The term "slot," as used herein, can be any opening, void, gap, eyelet, et cetera, on or through a continuous two- or three-dimensional shape or structure. Slots are not limited to any particular geometry and can include any size or shape opening including round, oval, linear, and polygonal shapes.

As used herein, spatially orienting terms such as "above," "below," "upper," "lower," "inner," "outer," "right," "left," "vertical," "horizontal," "top," "bottom," "upward," "downward," "laterally," "upstanding," et cetera, can refer to respective positions of aspects as shown in or according to the orientation of the accompanying drawings. "Inward" is intended to be a direction generally toward the center of an object from a point remote to the object, and "outward" is intended to be a direction generally away from an internal point in the object toward a point remote to the object. Such terms are employed for purposes of clarity in describing the drawings, and should not be construed as exclusive, exhaustive, or otherwise limiting with regard to position, orientation, perspective, configuration, and so forth.

Turning now to the figures, at least a strap guide insert 10 according to the invention can be illustrated in the drawings. Strap guide insert 10 can be used in connection with a container C having at least one opening O.

Figure 8:
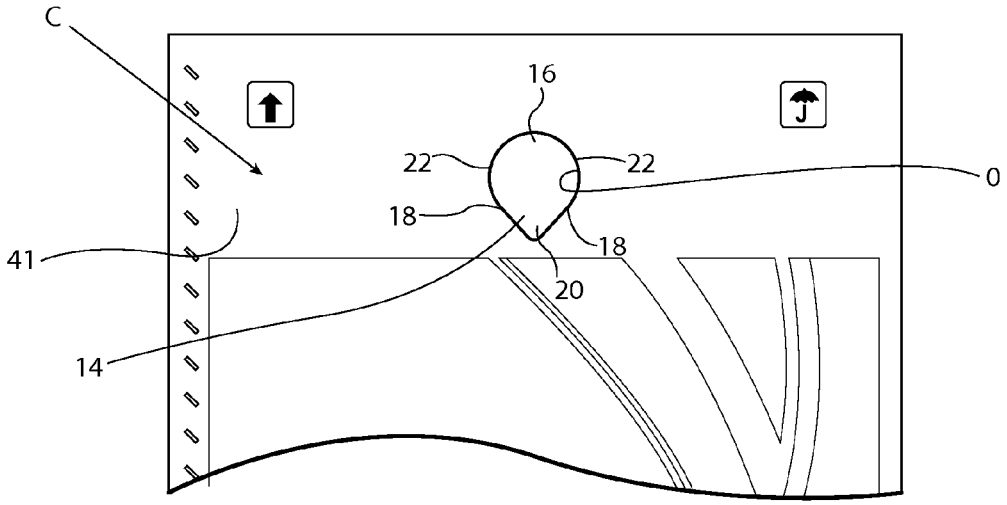
FIG. 8 is a front view of a container having a strap opening.
Figure 9:
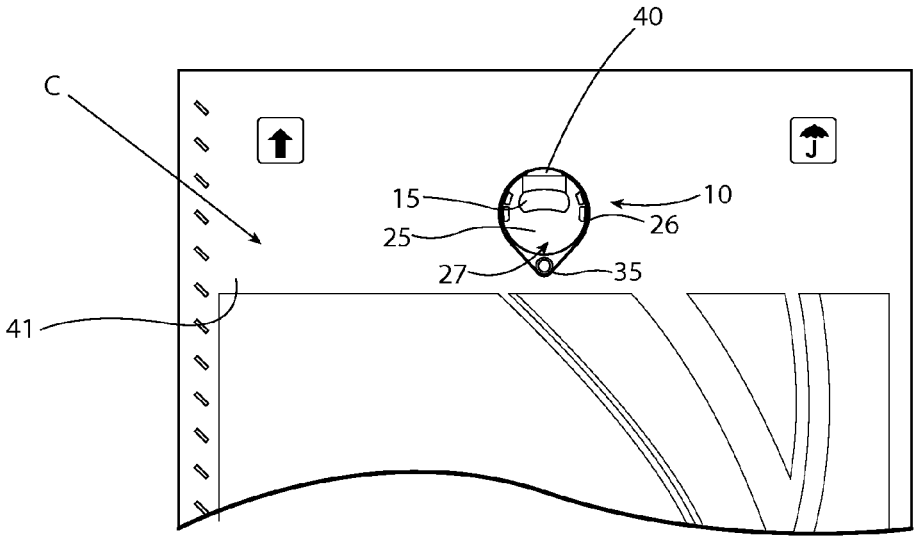
FIG. 9 is a front view similar to FIG. 8 with a strap guide insert secured within the opening.
Figure 10:
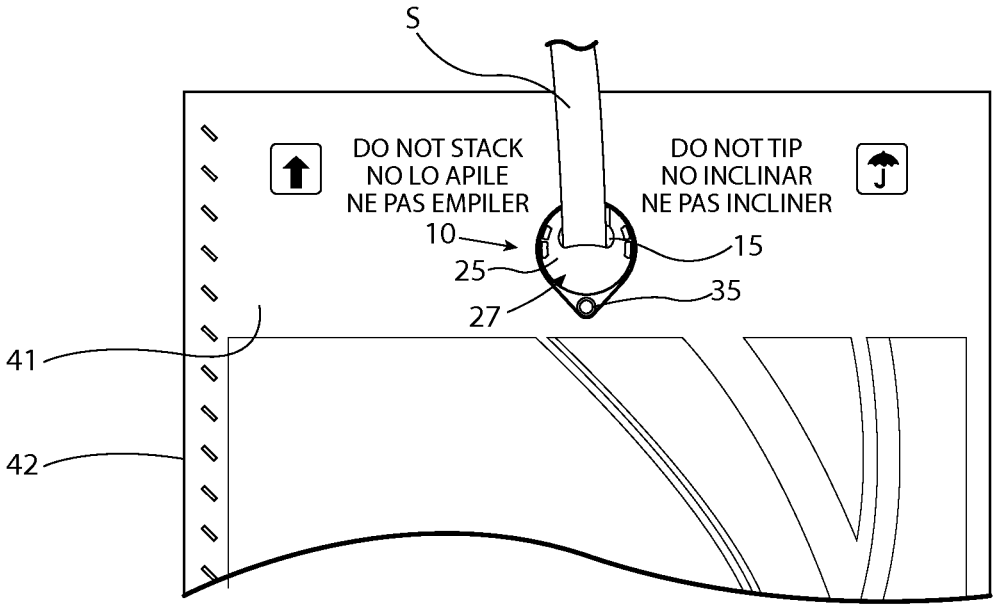
FIG. 10 is a front view similar to FIG. 9 with a strap extending through a slot in the strap guide insert.
Figure 11:
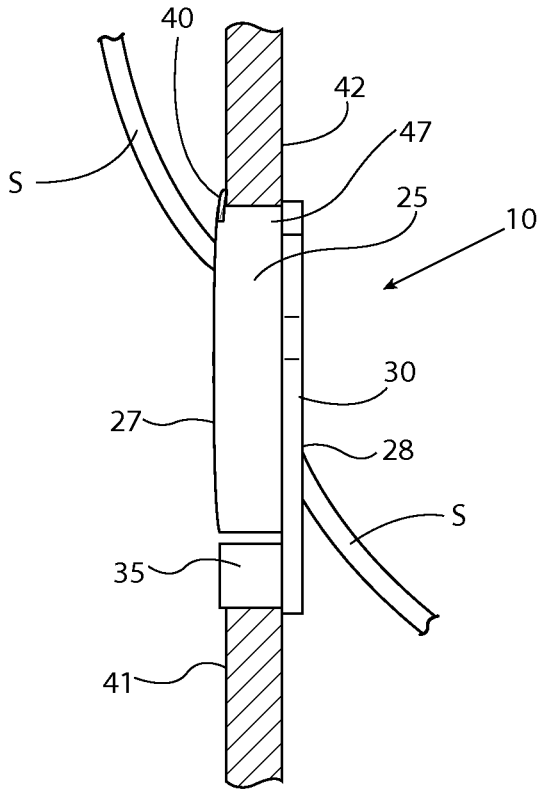
FIG. 11 is a partially sectioned side elevational view of the strap guide insert within an opening in a container.

The opening O may be a pre-existing opening in a container C or opening O may be cut into the container C for the purpose of installing strap guide insert 10. In the example shown in FIG. 8, opening O can have a lower portion 14 and an upper portion 16, where the upper portion 16 can have a greater lateral dimension than the lower extremity of the lower portion 14. It will be appreciated that the opening shown may be rotated such that the lower portion and upper portion can be inverted or other rotational positions between the inverted position and the position shown. In the example shown, lower portion 14 can have a triangular shape and upper portion 16 can have a semi-circular shape. The legs 18 of lower portion extend upward and outward from a tip 20 toward the outer lateral extremities 22 of upper portion 16.

With reference to at least FIGS. 1-7, strap guide insert 10 (or, e.g., a strap protector) can include a boss 25 (e.g., a strap boss) that can be insertable within opening O. Boss 25 defines a slot 15 for receiving the strap S as discussed more completely below. Boss 25 can have an outer periphery 26 that may be configured to fit an existing opening or have a custom shape. In the example shown, boss 25 can have a circular periphery 26 having a diameter D similar to the diameter D of opening O. As an option, diameter D of boss 25 may be larger than diameter D of opening O to create an interference fit between boss 25 and opening O. Boss 25 generally can have a first side 27 and a second side 28. It will be appreciated that installation of boss 25 in opening O may occur from the exterior of container C, such that first side 27 of boss 25 resides on an interior side of container C, or from the interior of container C, such that first side 27 of boss 25 resides on an exterior side of container C upon installation.

As discussed, depending on the shape of a pre-existing opening or a different orientation of the opening shown, the orientation of the strap guide insert 10 may change. Therefore, the orientation of the strap guide insert 10 upon installation should not be considered limiting when considering the structure of the strap guide insert 10. According to an aspect of the invention, flange 30 can extend outward from periphery 26 of boss 25 to overlie a second surface 42 of container C. Flange 30 can be located on the second side 28 of boss 25. Flange 30 may extend outward from any point along the periphery of boss 25. In the example shown, flange 30 can extend laterally outward and downward relative to the boss 25. Flange 30, shown, can include side portions 34 that can extend laterally outward along a horizontal axis of slot 15. Flange 30 may include, separately or in conjunction with side portions 34, lower portion 38 that extends downward from boss 25. In the example shown, side portions 34 and lower portion 38 can be interconnected to form a single flange 30. Although flange 30 can be symmetrically formed about a vertical centerline CL, it need not be so formed and other configurations of the flange 30 may be used without departing from the scope or spirit of the innovation. A plate or shaped plate portion can be used in at least a fashion similar to that of flange 30.

While flange 30, as illustrated, is embodied in a "chevron" shape, such aspects are not intended to be limiting. Flange 30 may have any shape, including various aspects that can include geometries that are round, polygonal, hybrid, et cetera, in two or more dimensions.

In specific embodiments, a secondary boss 35 may be provided on flange 30 extending inward therefrom to help locate boss 25 within opening O and prevent rotation of strap guide insert 10 (or at least a portion thereof) once installed. In the example shown, a cylindrical boss can extend inward from lower portion 38 of flange and may be centered along vertical centerline CL of strap guide insert 10. The lateral dimension of secondary boss 35 can be less than boss 25 in conformity with the opening O shown. In particular, secondary boss 35 can be sized to reside within the tip 20 of lower portion 14.

According to another aspect of the invention, lip 40 can extend beyond the periphery 26 of boss 25 to contact a surface of container C. In the example shown, lip 40 can extend from an upper portion 31 of boss 25 on a side opposite flange 30. In particular embodiments, lip 40 can be located on the first side 27 of boss 25 overlying a first surface 41 of container C while flange 30 can overlie a second surface 42 of container C. Lip 40 may have any shape suitable for overlying a portion of first surface 41. In particular embodiments like those illustrated, flange 40 can have a generally rectangular shape. The corners 44 and top surface 45 of lip 40 can be rounded to avoid sharp edges that might damage container C upon insertion.

According to specific embodiments, flange 30 need not extend to an upper extremity 47 of boss 25 opposite lip 40 to facilitate installation of strap guide insert 10 as discussed below. To install strap guide insert 10, a user can insert lip 40 inward through opening O and upward so that lip 40 can overlie first surface 41 of container C. The lower portion of boss 25 can be angled away from opening O during the insertion of lip 40. Once lip 40 overlies first surface 41, boss 25 may be rotated inward to press boss 25 into opening O. When a secondary boss 35 is provided, as in the example shown, rotation of boss 25 inward can cause secondary boss 35 to enter a lower portion of opening O. In the given example, secondary boss 35 resides within the narrow tip 20 of lower portion of opening O. Positioning of secondary boss 35 within tip 20 helps the user properly orient slot 15. In addition, secondary boss 35 reduces the likelihood that the strap guide insert 10 (or portions thereof) will unintentionally rotate after insertion.

Boss 25 may be solid, hollow, or a combination thereof. While a simple slot 15 may be formed in boss 25 to receive strap S, a strap receiver 50 may be provided to help guide strap S through boss 25 and route or configure the strap as desired for the application. In addition, strap receiver 50 may help distribute the forces created by strap S over a larger area to avoid damage to the container C or strap guide insert 10. Strap receiver 50 may have a variety of shapes and features depending on the given application. Examples shown, therefore, are not limiting.

Strap receiver 50 can include a top surface 51, a bottom surface 52 and a pair of sidewalls 54. Slot 15 can have a horizontal axis and a vertical axis. In the example shown, the horizontal axis of slot 15 can be greater than the vertical axis. The top surface 51 and bottom surface 52 may be rounded along with the corners 55 and 56 where the top surface 51 and bottom surface 52 meet sidewalls 54. In the example shown, top surface 51 and bottom surface 52 can both be arched upwardly (e.g., at least to a slight extent). In addition, sidewalls 54 may be bowed outward.

Figure 17:
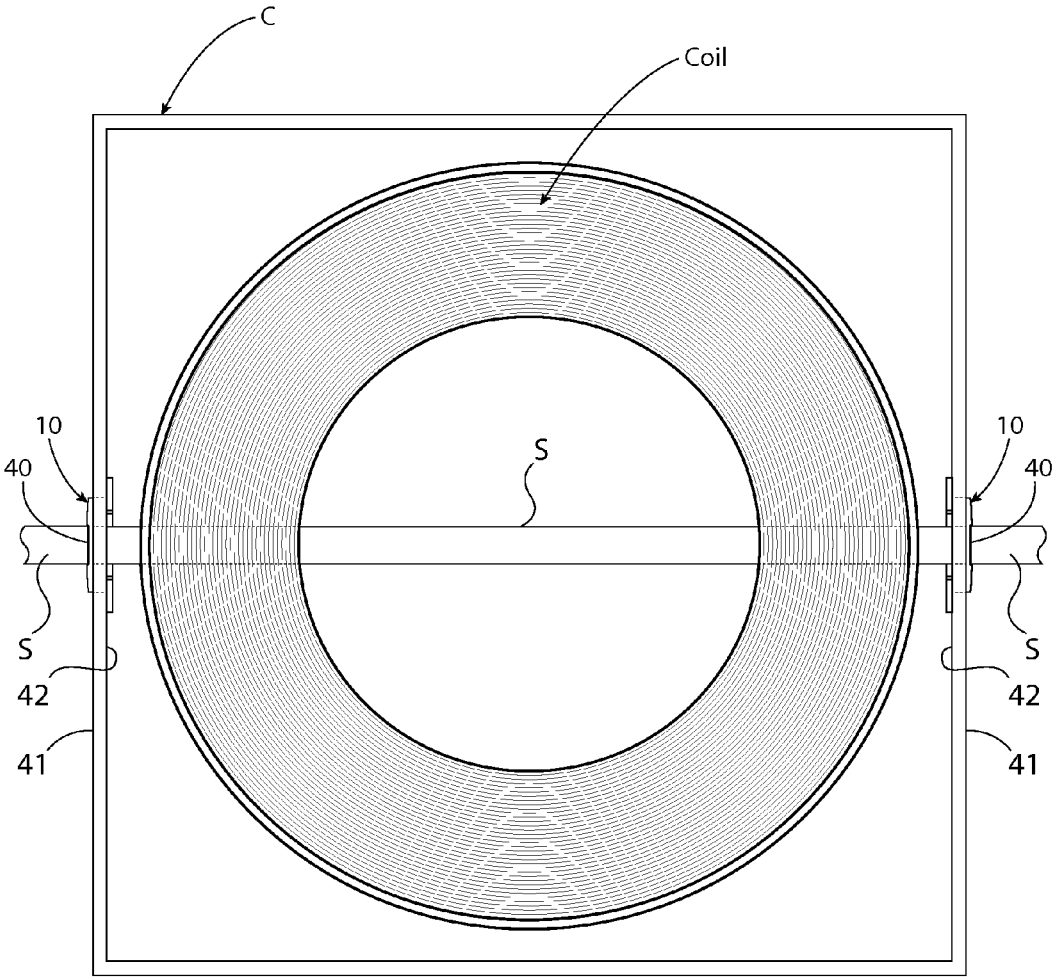
FIG. 17 is a top plan view of a container, having a pair of strap guides mounted on opposite sides thereof, with one or more straps being routed through the guides and beneath a coil of welding wire.

In accordance with another aspect of the invention (FIG. 17), a method of installing strap S in a container C may include inserting strap S through a first strap guide 10 such that it extends from an exterior of container C through boss 25 and downward to the bottom of container C, then upward along an opposite side of a container C before exiting through a second strap guide insert on an opposite side of container C. So routed, strap S forms a U-shape within container C. The contents of container C may be loaded over top of strap S when in this configuration. Indeed, the contents may directly contact strap S at the bottom of container or a buffer may be placed between the contents and strap S.

Strap S may act directly on the load within the container C. For example, a welding consumable, such as a wire coil, may be placed in the container C within the confines of strap S so that the strap S acts on the coil directly. It will be appreciated that with significant loads, such as a 250-500 kilogram coil of welding wire, the forces needed to lift the coil if acting solely on the sidewall of the container C could damage the container C (e.g., tear through container C). Routing the strap S beneath the coil can reduce the likelihood of damage to the container C. Reinforcement of the openings O with strap guides 10 can also reduce the likelihood of damage to the container.

To facilitate routing the strap S as described, strap receiver 50 may optionally include first and second strap guide channels 61, 62. First strap guide channel 61 can extend upward from slot 15 and toward first side 27 of boss 25. The second channel can extend downward from slot 15 and toward second side 28 of boss 25. In examples shown, to form first strap guide channel 61, top surface 51 of the strap receiver 50 can be recessed inward of the first side 27 of the boss 25, a top strap guide surface 63 extends upward and outward from top surface 51 of the slot receiver 50 to the first side 27 of the boss 25. A pair of top strap abutments 65 can be formed adjacent to the top strap guide surface 63 extending outward therefrom to the first side 27 of boss 25. In the example shown, top strap guide surface 63 can have a constant slope forming a ramp like channel 61 that guides strap S upward and outward in the example shown.

Second strap guide channel 62 may be formed similar to first strap guide channel 61 in the opposite direction. As shown, the bottom surface 52 of the strap receiver 50 can lie in a vertical plane defined by first side 27 of boss 25, a bottom strap guide surface 66 extends downward and outward from the bottom surface 52 of strap receiver 50 toward second side 28 of boss 25. A pair of bottom strap abutments 68 may be formed adjacent to the bottom strap guide surface 66 and extend toward second side 28 of boss 25. Sidewalls 54 may extend inward and below bottom surface 52 of slot 15 to form carve outs 70 on either side of second strap guide channel 62. These carve outs 70 may also bow outward as they extend toward second side 28 of boss 25. The curvature of sidewalls 54 and carve outs 70 may be useful in curling the edges of strap S to avoid the relatively sharp edge of a taut strap S from contacting any portion of the container C and causing damage thereto.

Figure 12:
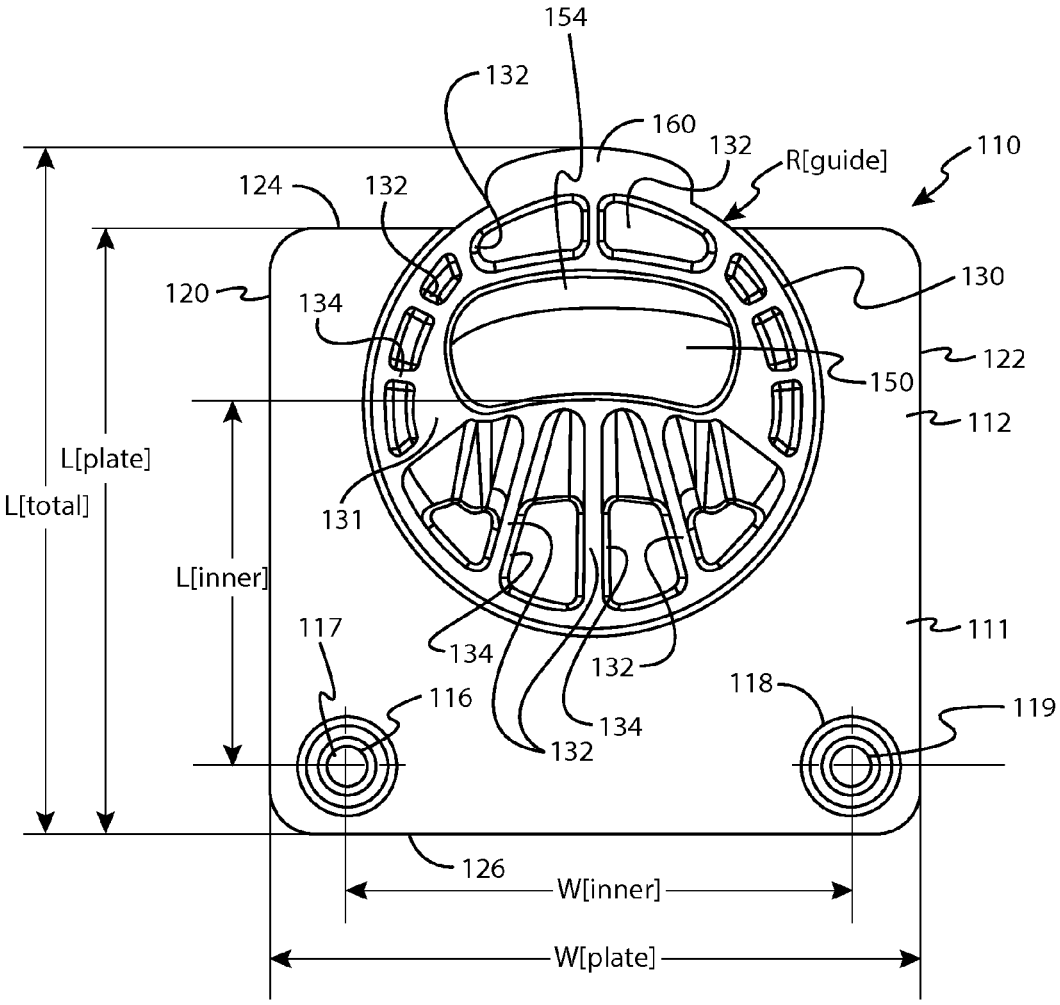
FIG. 12 is a front view of another embodiment of a strap guide according to the invention.

With specific reference to FIGS. 12-16, illustrated is alternative embodiments of a strap guide with a substantially square or rectangular shape. The strap protector guide portion 130 extends from the first side 112 and a portion 133 of the strap protector guide portion 130 extends beyond the third edge 124. The strap protector guide portion 130 has a planar strap protector guide surface 131. It is pointed out that because the strap protector body 111 is formed as a one-piece body **111*b*, the strap protector guide portion 130 is mergedly joined with the plate portion 111*a*. The strap protector guide portion 130 extends from the first side 112 the distance D as shown in FIGS. 12 and 116, and in one of the preferred embodiments the distance D is about 0.5 inches. It is pointed out that the planar strap protector guide surface 131 is substantially flush with the lug first and second ends 116*a*, 118*a* of the first and second lugs 116, 118**.

Figure 14:
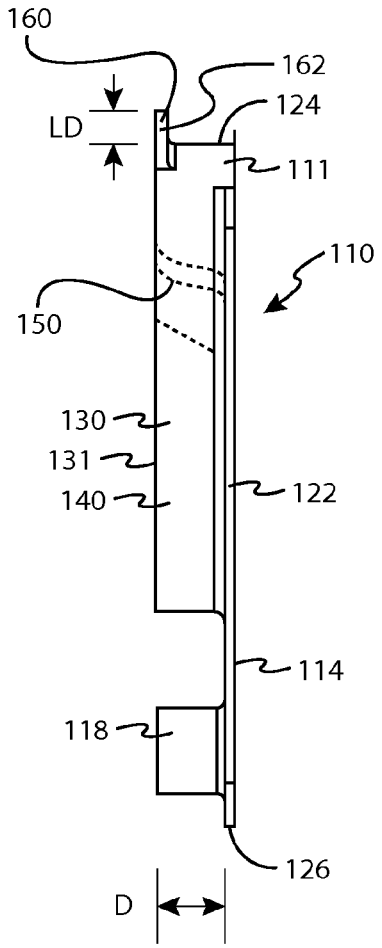
FIG. 14 is a left side view thereof.

As shown in FIGS. 12 and 14, the strap protector guide portion 130 is formed with a plurality of recesses commonly designated 132. The recesses 132 reduce weight and production costs of the strap protector 110, while at the same time still provide the strap protector 110 with sufficient strength to withstand loads imposed thereon. In one of the preferred embodiments the recesses 132 are defined by a plurality of ribs 134, and the plurality of ribs 134 provide the strap guide protector portion 130 with strength. In addition, the strap protector guide portion 130 has a surrounding wall 140 with an external surrounding surface 141, and the external surrounding surface 141 has a generally cylindrical shape in one of the preferred embodiments. In another preferred embodiment (not shown) all of the recesses 132 are filled with the material from which the strap protector 110 is made.

The strap protector body 111 of the strap protector 110 defines a strap opening 150 that extends completely through the strap protector body 111, and in particular through the plate portion 111*a* and through the strap protector guide portion 130. The strap protector opening 150 is sized such that a strap 180 can be passed through the strap opening 150.

Figure 13:
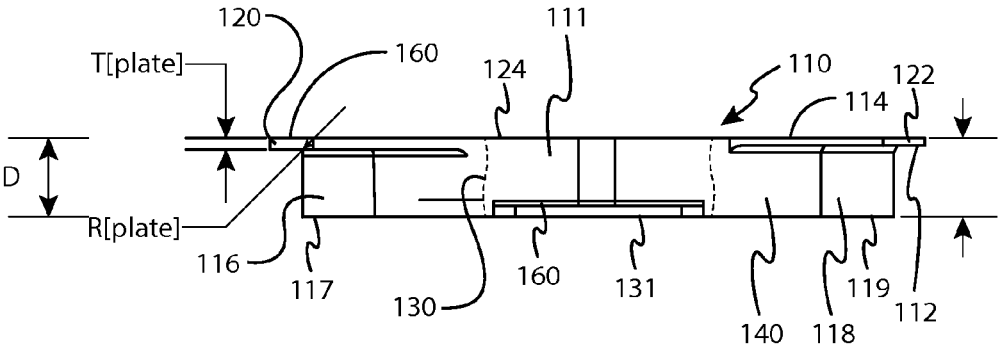
FIG. 13 is a top plan view thereof.
Figure 15:
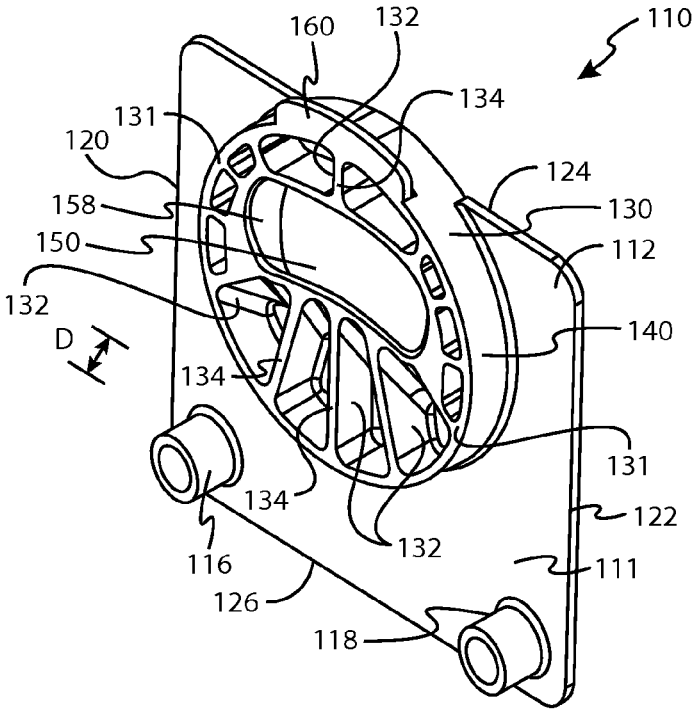
FIG. 15 is a front perspective view thereof
Figure 16:
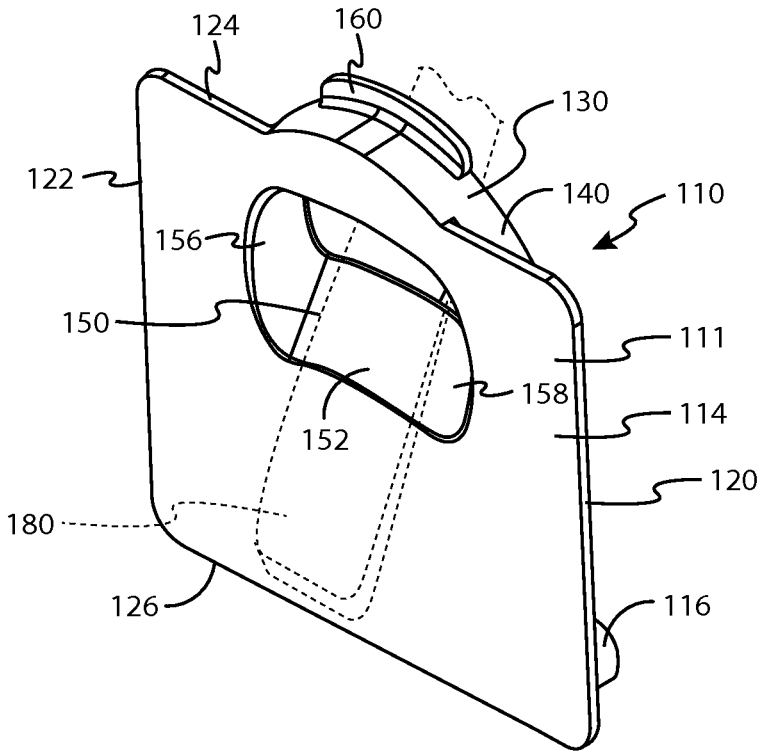
FIG. 16 is a rear perspective view thereof.

The strap protector body 111 is formed such that it has a first internal sloped surface 152 and a second internal sloped surface 154 that are spaced apart from one another and face one another. As shown in FIGS. 13, 14, and 15, each of the first internal sloped surface 152 and the second internal sloped surface 154 slopes insubstantially the same direction. The first internal sloped surface 152 and the planar strap protector guide surface 131 are at a first acute angle designated a relative to one another, and the second internal sloped surface 154 and the second side 114 are at a second acute angle designated b relative to one another, and in one of the preferred embodiments the angles a and b are the same. This results in each of the first and second sloped internal surfaces 152, 154 having a negative slope. In addition, in one of the preferred embodiments, the first internal sloped surface 152 is convex and the second internal sloped surface 154 is concave. The opposed internal first and second internal sloped surfaces 152, 154 are spaced from one another by first and second internal spacing surfaces 156, 158 that face one another. It is pointed out that the internal first and second spacing surfaces 156, 158 are concave on the preferred embodiments, such that the strap 180 is not exposed to sharp corners or edges. Together, the internal first and second internal sloped surfaces 152, 154 and the first and second internal spacing surfaces 156, 158 define the strap opening 150.

In addition, the strap guide portion 130 has a protruding portion 130*a* that extends or protrudes beyond the third edge 124 of the plate portion 111*a*. A lip 160 extends from the protruding portion 130*a* of the strap guide portion 130. The lip 160 is flush with the planar strap protector guide surface 131 and extends beyond the surrounding wall 140 of the strap guide protector portion 130.

In embodiments, there can be more than one secondary boss. For example, two, three, or more secondary bosses can be employed to resist rotation, unintentional removal, and/or other undesirable movement or deformation of a strap guide insert or the container to which it is inserted. In alternative or complementary embodiments, one or more lugs can be used in place of or in conjunction with a secondary boss.

In various embodiments, a strap guide insert and/or protector can be designed of two or more distinct parts or components that can rotate with relation to one another. For example, one or more secondary bosses can remain fixed with respect to a container, while a boss through which a strap-accepting portion (e.g., a slot) passes can rotate with respect to the one or more secondary bosses or one or more flanges. For example, a strap guide insert and/or protector can be designed such that a strap-accepting portion can rotate with the strap while the remainder can remain stably fixed in the container.

In embodiments, at least a portion of a strap guide insert and/or protector can be flexible or semi-flexible. For example, a flange with a strap guide insert can be made of a material that can flex to permit insertion into a container opening smaller than a dimension of the flange. In embodiments, a flange can be designed to flex in one direction, and/or be constructed of or coated with a friction-increasing material (e.g., rubberized, knurled, and so forth) that will resist additional flexing of the flange after the strap guide insert is installed in the container.

In embodiments, at least a portion of a strap guide insert and/or protector can be rigid. In rigid embodiments, one or more portions of the strap guide insert and/or protector can be made of composite materials, and/or laced or threaded with hardening materials to prevent partial or total failure during installation or use.

In particular embodiments, portions of the strap guide insert can be foldable. In embodiments, flexible materials can be used to facilitate folding. In alternative embodiments, rigid materials can be used in conjunction with hinges or other pivot points. Folding motion can be restricted to particular directions and/or magnitudes of rotation, and in embodiments the folding portions or pivot points to which the folding portions are connected can be reinforced or include stops to avoid rotation in excess or improper direction.

In embodiments, a snap guide insert and/or protector can include various connectors, receivers, and/or mating portions. For example, various snaps, clamps, ratchets, claws, buckles, buttons, et cetera, can be employed to connect or provide additional support for a strap interfacing with a strap guide insert.

Similarly, in alternative or complementary embodiments, a strap guide insert or protector in accordance with the herein can include attachment points that interface with connectors on a container. For example, a strap guide insert can include various snaps, clamps, ratchets, claws, buckles, buttons, et cetera, that connect or provide additional support for contact of the strap guide insert with the container.

Various aspects related to the disclosure can include embodiments of a container configured for use with a strap guide or protector as described herein. Such a container can comprise two or more interfaces configured to accept two or more strap guides, wherein the two or more interfaces have a teardrop shape with a wide portion and a narrow portion, the wide portion configured to accept a boss include a strap receiver, and the narrow portion configured to support at least one lug to prevent rotation of the two or more strap guides. The container can be further configured to allow a continuous length of strap to pass through the container. In embodiments, the continuous length of strap can pass under at least a portion of a load in the container. Alternative or complementary embodiments of such a container can include at least one strap guide having a shaped plate portion from which can extend an insert portion having an engagement lip and at least one lug suited for retention in the narrow portion of the teardrop, wherein the strap guide can be fitted in one of the two or more interfaces and retained therein by at least the shaped plate portion, the at least one lug, and the engagement lip.

Various embodiments herein need not include the described and/or illustrated geometries. Circular bosses and/or chevron-shaped flanges merely suggest some possible embodiments that can be cognized under the disclosures herein. For example, various polygonal shapes can be employed. Straight-line geometries can be employed in place of rounded portions and vice versa. Diameters d and D can instead represent lengths, widths, and so forth. Thus, while one or more particular embodiments have been described in detail, these details are not to be interpreted as exhaustive or exclusive.

Embodiments herein can be constructed of various materials. One or more portions of a strap guide insert and/or protector can be made of (but are not limited to) different types of plastic, metal, ceramic, rubber, glass, carbon, and other suitable materials. Where necessary or desirable (e.g., with rotating or folding embodiments), known structures such as rails, hinges, springs, and others can be employed with aspects herein without departing from the scope or spirit of the innovation.

While principles and modes of operation have been explained and illustrated with regard to particular embodiments, it must be understood that this may be practiced otherwise than as specifically explained and illustrated without departing from its spirit or scope.

What has been described above includes examples of the subject innovation. It is, of course, not possible to describe every conceivable combination of components or methodologies for purposes of describing the claimed subject matter, but one of ordinary skill in the art may recognize that many further combinations and permutations of the subject innovation are possible. Accordingly, the claimed subject matter is intended to embrace all such alterations, modifications, and variations that fall within the spirit and scope of the appended claims.

Specific embodiments of an innovation are disclosed herein. One of ordinary skill in the art will readily recognize that the innovation may have other applications in other environments. In fact, many embodiments and implementations are possible. The following claims are in no way intended to limit the scope of the subject innovation to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

Although the subject innovation has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (e.g., enclosures, sides, components, assemblies, etc.), the terms (including a reference to a "means") used to describe such elements are intended to correspond, unless otherwise indicated, to any element which performs the specified function of the described element (e.g., that is functionally equivalent), even though not structurally equivalent to the disclosed structure which performs the function in the herein illustrated exemplary embodiment or embodiments of the innovation. In addition, while a particular feature of the innovation may have been described above with respect to only one or more of several illustrated embodiments, such feature may be combined with one or more other features of the other embodiments, as may be desired and advantageous for any given or particular application. Although certain embodiments have been shown and described, it is understood that equivalents and modifications falling within the scope of the appended claims will occur to others who are skilled in the art upon the reading and understanding of this specification.

In addition, while a particular feature of the subject innovation may have been disclosed with respect to only one of several implementations, such feature may be combined with one or more other features of the other implementations as may be desired and advantageous for any given or particular application. Furthermore, to the extent that the terms "includes," "including," "has," "contains," variants thereof, and other similar words are used in either the detailed description or the claims, these terms are intended to be inclusive in a manner similar to the term "comprising" as an open transition word without precluding any additional or other elements.

What is claimed is:

1. A container comprising:

a welding consumable housing portion configured to store a welding consumable; and at least one strap guide operatively coupled with the welding consumable housing portion, the at least one strap guide having a plate portion substantially matching a contour of a surface of the welding consumable housing portion, and the at least one strap guide having a guide portion configured to receive a strap wherein the guide portion of the at least one strap guide has a first internal sloped surface and a second internal sloped surface, the first internal sloped surface and the second internal sloped surface each being oblique to an outside face of the plate portion.

2. The container of claim 1, wherein the welding consumable housing portion is at least in part a box.

3. The container of claim 1, wherein the welding consumable housing portion is at least in part a cylinder.

4. The container of claim 1, wherein the at least one strap guide includes two or more strap guides.

5. The container of claim 1, further comprising one or more straps operatively coupled with the at least one strap guide.

6. The container of claim 1, further comprising a welding consumable within the welding consumable housing portion.

7. The container of claim 6, wherein the welding consumable is a coil of welding wire.

8. The container of claim 1, wherein the internal sloped surface and external sloped surface are oblique to an inward face of the plate portion.

9. A container comprising:

a welding consumable housing portion configured to store a welding consumable; and at least one strap guide operatively coupled with the welding consumable housing portion, the at least one strap guide having a plate portion substantially matching a contour of a surface of the welding consumable housing portion, and the at least one strap guide having a guide portion configured to receive a strap wherein the guide portion includes a strap opening and a first sloped surface extending inward and downward from an outer face of the plate portion to the opening and a second sloped surface extending downward and inward from the opening and into an interior of the container.

10. The container of claim 9, wherein at least one strap guide includes a boss that extends inward from the plate portion and is receivable in an opening in the container, wherein the strap opening is formed in the boss.

11. The container of claim 10, wherein the boss has a cylindrical outer surface.

12. The container of claim 10, wherein the boss includes an interior edge that extends inward of the opening in the container and a lip extending radially outward from the boss at the interior edge to engage an inner surface of the container.

13. The container of claim 12, wherein the lip extends upward from the boss.

14. The container of claim 12 further comprising at least one lug extending inward from the plate portion outward of the boss and engagable with the container.

15. A container comprising:

a welding consumable housing portion configured to store a welding consumable; and at least one strap guide operatively coupled with the welding consumable housing portion, the at least one strap guide having a plate portion substantially matching a contour of a surface of the welding consumable housing portion, and the at least one strap guide having a guide portion configured to receive a strap, wherein the strap guide portion includes a strap opening through which the strap is received and a first sloped surface extending inward toward the strap opening and a second sloped surface extending outward from the strap opening.

16. The container of claim 15, wherein the second sloped surface extends downward from the strap opening and into an interior of the container.

17. The container of claim 16, further comprising a strap protector portion that includes a wall that extends into an opening formed in the container, wherein the strap opening, first sloped surface and second surface are formed in the strap protector portion.

18. The container of claim 17, wherein the wall of the strap protector is cylindrical.

* * * * *